US007954314B1

(12) United States Patent
Bruestle et al.

(10) Patent No.: US 7,954,314 B1
(45) Date of Patent: Jun. 7, 2011

(54) MARINE PROPULSION SYSTEM WITH A CATALYST CONTAINED WITHIN THE BODY OF THE ENGINE

(75) Inventors: Claus Bruestle, Fond du Lac, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 1120 days.

(21) Appl. No.: 11/219,948

(22) Filed: Sep. 6, 2005

(51) Int. Cl.
*F01N 3/00* (2006.01)

(52) U.S. Cl. ..... 60/313; 60/302; 60/323

(58) Field of Classification Search ..... 69/302, 69/313, 323; 440/89 R, 89 H
See application file for complete search history.

(56) References Cited

U.S. PATENT DOCUMENTS

| | | | | |
|---|---|---|---|---|
| 4,900,282 | A | 2/1990 | Takahashi et al. | 440/89 |
| 5,203,167 | A | 4/1993 | Lassanske et al. | 60/298 |
| 5,212,949 | A * | 5/1993 | Shiozawa | 60/298 |
| 5,239,825 | A | 8/1993 | Shibata | 60/302 |
| 5,346,417 | A | 9/1994 | Isogawa | 440/89 |
| 5,378,180 | A | 1/1995 | Nakayama et al. | 440/89 |
| 5,413,767 | A | 5/1995 | Breuer et al. | 422/174 |
| 5,439,651 | A | 8/1995 | Kato | 422/179 |
| 5,490,382 | A | 2/1996 | Kato | 60/297 |
| 5,494,467 | A * | 2/1996 | Sohgawa et al. | 440/89 R |
| 5,546,748 | A | 8/1996 | Iwai et al. | 60/302 |
| 5,822,985 | A | 10/1998 | Yoshimura | 60/302 |
| 5,855,495 | A | 1/1999 | Kubo | 440/89 |
| 5,916,135 | A | 6/1999 | Yoshida et al. | 60/302 |
| RE36,888 | E | 10/2000 | Sougawa et al. | 60/302 |
| 6,660,235 | B1 | 12/2003 | Holpp et al. | 422/180 |
| 6,662,555 | B1 | 12/2003 | Ishii | 60/302 |
| 6,884,133 | B2 * | 4/2005 | Ishii | 440/89 H |

FOREIGN PATENT DOCUMENTS

| | | |
|---|---|---|
| DE | 40 38 169 | 11/1990 |
| GB | 2 231 283 | 4/1990 |

* cited by examiner

*Primary Examiner* — Thomas E Denion
*Assistant Examiner* — Diem Tran
(74) *Attorney, Agent, or Firm* — William D. Lanyi

(57) ABSTRACT

An engine is provided with a cavity so that a catalyst member can be contained within the engine when an engine head portion is attached to an engine block portion. This attachment of the engine head portion and engine block portion, which forms the engine structure, captivates the catalyst member within the cavity without the need for additional brackets and housing structures. The cavity is preferably located above or at the upper regions of first and second exhaust conduits which direct exhaust upwardly from the engine head portion toward the cavity and downwardly from the cavity within the engine block portion. The first and second exhaust conduits are preferably formed as integral structures within the engine head portion and engine block portion.

37 Claims, 5 Drawing Sheets

MARINE PROPULSION SYSTEM WITH A CATALYST CONTAINED WITHIN THE BODY OF THE ENGINE

BACKGROUND OF THE INVENTION

1. Field of the Invention

The present invention is generally related to a marine propulsion engine with a catalyst and, more particularly, to an engine in which a catalyst is contained within a cavity and retained in position between the engine block and the engine head.

2. Description of the Prior Art

It is well known to those skilled in the art of engine design that various types of catalysts can be beneficial in reducing exhaust emissions emanating from the engine. Those skilled in the art are also familiar with many types of configurations in which catalysts are used in conjunction with engines of marine propulsion systems.

U.S. Pat. No. 6,660,235, which issued to Holpp et al. on Dec. 9, 2003, describes a catalyst carrier configuration for installation close to an engine. The configuration includes a housing and at least one catalyst carrier body disposed in the housing. The body has partition walls defining a plurality of passages for an exhaust gas. A flange surrounds the catalyst carrier body and extends radially outwards from the catalyst carrier body.

British Patent GB 2 231 283, which was filed on Apr. 5, 1990, describes an exhaust gas cleaning device that is constructed of a honeycomb core body defining a number of network-patterned axial gas flow passages. Around the central axis of the honeycomb core body, there is also defined a cylindrical hollow space of an outer diameter satisfying a particular formula.

U.S. Pat. No. 5,413,767, which issued to Breuer et al. on May 9, 1995, describes a mechanically stabilized heating catalyst configuration. The apparatus includes first and second honeycomb bodies through which a fluid can flow in succession. At least one of the honeycomb bodies is heatable and the honeycomb bodies each have a multiplicity of channels formed therein defining channel walls.

German disclosure document DE 40 38 169, which was filed on Nov. 30, 1990 by Christl et al., describes an internal combustion engine with a motor housing consisting of a cylinder head in a crankcase. The arrangement comprises an exhaust port system located in the motor housing to convey the exhaust gases from the combustion chamber to an exhaust line system. It has an exhaust filtering element, or catalytic converter, which is located in the path of the exhaust gas. In order to maintain the temperature level required for proper operation of the exhaust filtering element located in the path of the exhaust gas without additional is measures, it is proposed that the exhaust gas filtering element be located in the motor housing and within the exhaust port system.

U.S. Pat. No. 5,916,135, which issued to Yoshida et al. on Jun. 29, 1999, describes an engine exhaust emission control system for an outboard engine system. The system is intended for use with a four cycle outboard engine. The engine comprises a mounting member, an engine block mounted on the mounting member, an extension housing coupled to the mounting member and extending downward therefrom, and an engine oil pan mounted under the mounting member within the extension housing. The engine exhaust emission control system comprises a catalyst assembly positioned in the exhaust gas expansion chamber, the catalyst assembly having a catalyst case aligned with the oil pan in the lengthwise direction thereof.

U.S. Pat. No. 4,900,282, which issued to Takahashi et al. on Feb. 13, 1990, describes an exhaust gas purifying device for a marine engine. The catalyzer material is supported by a heat conductive bracket and the bracket is cooled by a cooling jacket that is supplied with coolant from the engine cooling jacket. In one embodiment, the water jacket is cooled both internally and externally by delivering water from the cooling jacket into the exhaust system to impinge upon a wall of the cooling jacket.

U.S. Pat. No. 5,203,167, which issued to Lassanske et al. on Apr. 20, 1993, describes a marine propulsion device internal combustion engine. An exhaust catalyst apparatus is mounted on the cylinder block and includes a tongue extending into the cylinder block exhaust passage and dividing the cylinder block exhaust passage into an upstream portion communicating with the exhaust port and a downstream portion communicating with the exhaust outlet. The apparatus includes an exhaust passage communicating between the upstream portion and the downstream portion and a catalyst is located in the apparatus exhaust passage.

U.S. Pat. No. 5,239,825, which issued to Shibata on Aug. 31, 1993, describes an exhaust emission control device for an outboard motor. A catalyst material holding structure is mounted within an exhaust passage of an engine. A thermally insulating interstice is located between an inner wall of the exhaust passage and the outer periphery of the catalyst material holding structure, so that the interstice physically separates the catalyst material holding structure from the inner wall of the exhaust passage.

U.S. Pat. No. 6,662,555, which issued to Ishii on Dec. 16, 2003, describes a catalyzer arrangement for an engine. The arrangement includes an improved construction that does not require a large space for furnishing a relatively large volume catalyzer. The engine is surrounded by a protective cowling. A cylinder body of the engine has a plurality of cylinder bores spaced apart from each other. At least one catalyzer is disposed in the exhaust passage of the engine.

U.S. Pat. Re. 36,888, which issued to Sougawa et al. on Oct. 3, 2000, describes an exhaust gas purifying device for an outboard motor. At least one exhaust port is provided which opens into a first exhaust passage having a first catalyst member lining at least a portion of its inner wall. The first exhaust passage then opens into an exhaust expansion chamber. Next, a second exhaust passage originates just beyond the expansion chamber. A second catalyst member is mounted within and across a section of exhaust passage beyond the first exhaust passage and at a location above the water line within which the outboard motor operates.

U.S. Pat. No. 5,546,748, which issued to Iwai et al. on Aug. 20, 1996, describes an exhaust system for an outboard motor. A number of embodiments of exhaust systems for outboard motors including a combined is catalyst bed and exhaust manifold forming member affixed within the cylinder block of the engine so as to be readily detachable for servicing. This combined member is provided with a separate cooling jacket for its cooling.

U.S. Pat. No. 5,490,382, which issued to Kato on Feb. 13, 1996, describes a catalyzer support system for exhaust cleaning of an outboard motor. A catalytic exhaust treatment system for an outboard motor is described wherein a catalyst bed is supported within the exhaust pipe on a support plate that permits the catalyst bed to expand and contract relative to the surrounding exhaust pipe from which it is spaced. The exhaust gases can flow through the catalyst bed and around the catalyst bed for complete treatment.

U.S. Pat. No. 5,822,985, which issued to Yoshimura on Oct. 20, 1998, describes an exhaust passage structure of an outboard motor. The structure is provided for an outboard motor unit having an engine holder mounted to a hull through a bracket, an engine disposed to an upper portion of the engine holder, a driveshaft housing disposed to a lower portion of the engine holder and an exhaust passage structure extending from the engine into water through the driveshaft housing. An opening is provided and opened at a position between the location of the bracket, preferably the catalyst disposed in the first exhaust expansion chamber, and an upper end of the engine cylinder so that the water does not enter the second exhaust expansion chamber even if a draft line of the water rises.

U.S. Pat. No. 5,855,495, which issued to Kubo on Jan. 5, 1999, describes an exhaust gas cleaning device of an outboard motor unit. A catalyst is disposed below the engine and inside a space having substantially a triangle shape, in a plan view, defined by a central line of one of the cylinder rows, a central line of another one of the cylinder rows and a central line of the expansion exhaust chamber.

U.S. Pat. No. 5,439,651, which issued to Kato on Aug. 8, 1995, describes a catalyzer support system for exhaust cleaning of an outboard motor. A catalyst exhaust treatment system for an outboard motor is described wherein a catalyst bed is supported within the exhaust pipe of a support plate that permits the catalyst bed to expand and contract relative to the surrounding exhaust pipe from which it is spaced. The exhaust gases can flow through the catalyst bed and around the catalyst bed for complete treatment.

U.S. Pat. No. 5,378,180, which issued to Nakayama et al. on Jan. 3, 1995, describes an exhaust system for an outboard motor. Two embodiments of outboard motors embodying tuned exhaust systems having exhaust pipes and expansion chambers into which the exhaust pipes extend are described. A catalyst is positioned in the exhaust system downstream of the point where the exhaust pipe terminates in the expansion chamber so as to preclude interference with the exhaust tuning. The catalyst bed is removable for ease of servicing without necessitating removal of the outboard from its attachment to the associated watercraft and a trap device is provided for precluding water from entering the engine through its exhaust ports.

U.S. Pat. No. 5,346,417, which issued to Isogawa on Sep. 13, 1994, describes an exhaust gas cleaning device for an outboard motor. An expansion chamber is formed in the driveshaft housing and the exhaust gases are delivered to the expansion chamber from an exhaust pipe that extends at least in part through the expansion chamber and which terminates at its lower end in the lower portion of the expansion chamber. A catalyst bed is positioned at the upper end of the expansion chamber and beneath the engine and through which the exhaust gases must pass for discharge through a further exhaust conduit which extends at least in part through the expansion chamber and which terminates at an underwater exhaust gas discharge.

The patents described above are hereby expressly incorporated by reference in the description of the present invention.

It would be significantly beneficial if a simple, but rugged, arrangement for containing a catalyst member in association with an exhaust stream could be provided. It would be particularly beneficial if the arrangement for attachment could be compact, require little or no extra space for the catalyst member, and securely contain the catalyst member in an appropriate position relative to the stream of exhaust gas emanating from the engine.

SUMMARY OF THE INVENTION

An engine of a marine propulsion system, made in accordance with a preferred embodiment of the present invention, comprises an engine head portion, an engine block portion, a catalyst member, and a cavity formed within the body of the engine. The engine head portion has a first exhaust conduit formed integrally within the head portion. The engine block portion has a second exhaust conduit formed integrally within the engine block portion. The engine block portion and the engine head portion are attachable to each other at a connection plane in order to form a complete engine. The first and second exhaust conduits are connectable to each other in fluid communication at an intersection to direct exhaust from the engine head portion to an exhaust outlet of the engine. The first exhaust conduit is configured to direct the exhaust upwardly from the engine head portion toward the intersection. The second exhaust conduit is configured to direct the exhaust downwardly from the intersection to the exhaust outlet of the engine. The cavity is formed within the body of the engine. The cavity is shaped to receive the catalyst member therein and the catalyst member is disposed within the cavity.

In certain embodiments of the present invention, the cavity is formed entirely within the engine block portion. In alternative embodiments, the cavity is formed entirely within the engine head portion. In some embodiments of the present invention, the cavity is formed partially within the engine block portion and partially within the engine head portion. The catalyst member is retained within the cavity by the attachment of the engine head portion to the engine block portion. The exhaust is directed to pass through the cavity along a generally horizontal path in a preferred embodiment of the present invention. The cavity is preferably located in an upper half of the engine and at the intersection between the first and second exhaust conduits. The cavity is located at a highest point of both the first and second exhaust conduits in a particularly preferred embodiment of the present invention.

The catalyst member, in a preferred embodiment of the present invention, comprises a plurality of passages formed therethrough. The plurality of passages are disposed generally in parallel association with a flow of exhaust through the cavity. The intersection between the first and second exhaust conduits can be disposed above a vertical midpoint of the first exhaust conduit or, in certain preferred embodiments, the intersection can be disposed completely above most of the first exhaust conduit or completely above most of the second exhaust conduit.

The first exhaust conduit can be divided into two or more paths to segregate exhaust from a first plurality of combustion chambers of the engine from a second plurality of combustion chambers of the engine as the exhaust is directed toward the cavity and toward the catalyst member. The engine can comprise four cylinders in certain embodiments of the present invention or six cylinders in other embodiments. It should be understood that the number of cylinders contained within the engine is not limiting to the present invention.

BRIEF DESCRIPTION OF THE DRAWINGS

The present invention will be more fully and completely understood from a reading of the description of the preferred embodiment in conjunction with the is drawings, in which.

DESCRIPTION OF THE PREFERRED EMBODIMENT

Figure 1:
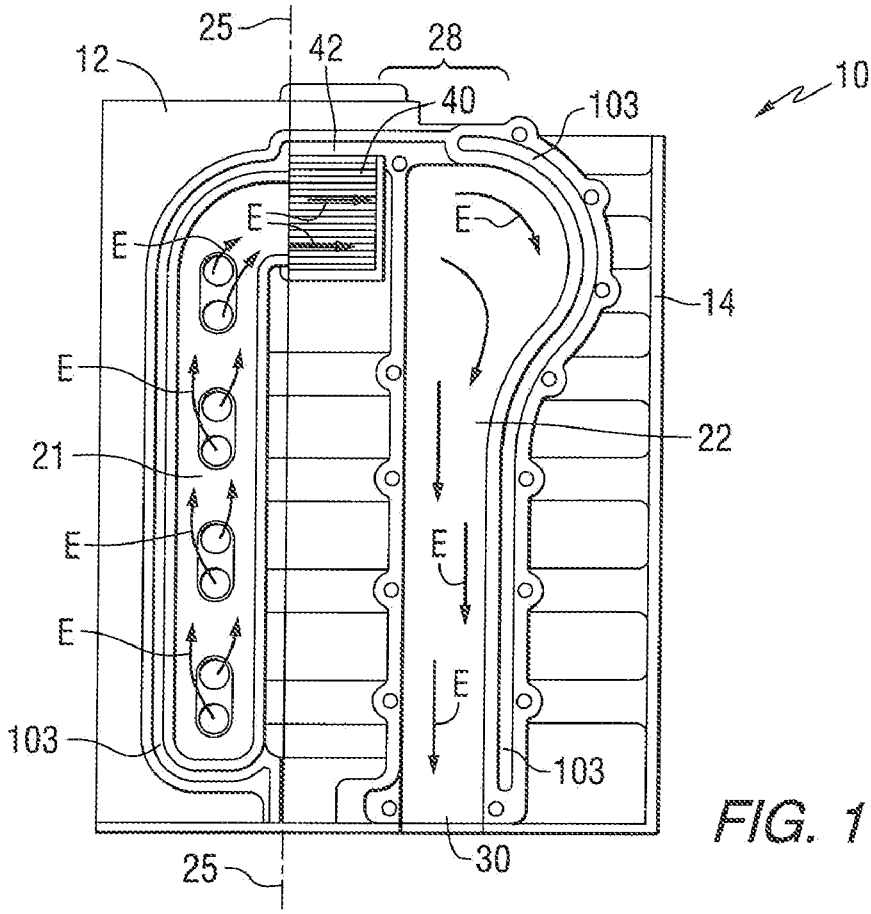
FIG. 1 is a section view showing one embodiment of the present invention.

Throughout the description of the preferred embodiment of the present invention, like components will be identified by like reference numerals.

FIG. 1 is a section view of an engine 10 of a marine propulsion system. It comprises an engine head portion 12 and an engine block portion 14. The engine head portion 12 has a first exhaust conduit 21 formed integrally within the engine head portion. The engine block portion 14 has a second exhaust conduit 22 formed integrally within the engine block portion. As shown in FIG. 1, the engine block portion 14 and the engine head portion 12 are attachable to each other at a connection plane 25 to form the engine 10. The first and second exhaust conduits, 21 and 22, are connectable to each other in fluid communication at an intersection 28 to direct exhaust from the engine head portion 12 to an exhaust outlet 30 of the engine 10. The first exhaust conduit 21 is configured to direct exhaust upwardly from the engine head portion, as represented by the arrows E within the first exhaust conduit 21, toward the intersection 28. The second exhaust conduit 22 is configured to direct the exhaust downwardly, as represented by arrows E within the second exhaust conduit 22, from the intersection 28 to the exhaust outlet 30 of the engine 10. As can be seen in FIG. 1, the first and second exhaust conduits, 21 and 22, are generally parallel to each other and generally parallel to an axis of rotation about which the crankshaft of the engine 10 rotates. The alignment of the exhaust ports, from which the exhaust E emanates in the head portion 12 of the engine 10 as shown in FIG. 1 defines the relative location of the cylinders and pistons within the engine 10 and, as a result, also defines the direction in which the crankshaft extends. The present invention is intended for use in conjunction with a marine propulsion system, such as an outboard motor, and the rotational axis of the crankshaft is therefore generally vertical.

With continued reference to FIG. 1, a marine propulsion system made in accordance with a preferred embodiment of the present invention further comprises a catalyst member 40 which is disposed within a cavity 42 that is formed within the body of the engine 10. The cavity 42 is shaped to receive the catalyst member 40 therein. The catalyst member 40 is disposed within the cavity 42 as illustrated in FIG. 1. As shown in FIG. 1, the catalyst member 40 is located completely within the engine block portion 14 toward the right of the connection plane 25 in the illustration. It should be understood that the position of the cavity 42 could alternatively be located completely within the engine head portion 12 to the left of the connection plane 25. In yet another alternative embodiment, the cavity 42 could be located partially located within the engine block portion 14 and partially within the engine head portion 12.

With continued reference to FIG. 1, the exhaust E is directed to pass through the cavity 42 along a generally horizontal path in a preferred embodiment of the present invention. In addition, the cavity 42 is located in an upper half of the engine 10 and at the intersection 28 where the cavity 42 is located. In the embodiment shown in FIG. 1, the cavity 42 is located at the highest point of both the first and second exhaust conduits, 21 and 22. It is beneficial to position the cavity 42 and its catalyst 40 at a location which is in the upper portion of the engine 10. The reason for this advantage is that this upper position within the engine 10 decreases the likelihood that water will flow into contact with the catalyst member 40 in the event that water is drawn upward through the second exhaust conduit 22 during the operation of the engine 10. If the water moves into direct contact with the catalyst member 40, deleterious effects regarding the ability of the catalyst 40 to operate properly can occur.

The catalyst member 40 can comprise a plurality of passages formed therethrough. One example of this type of structure is shown in U.S. Pat. No. 6,660,235 which is described above. An alternative configuration of a catalyst member, which also has a plurality of passages formed therethrough, is illustrated and described in British Patent GB 2 231 283. The plurality of passages can be disposed generally in parallel association with the flow of exhaust E through the cavity 42.

Figure 2:
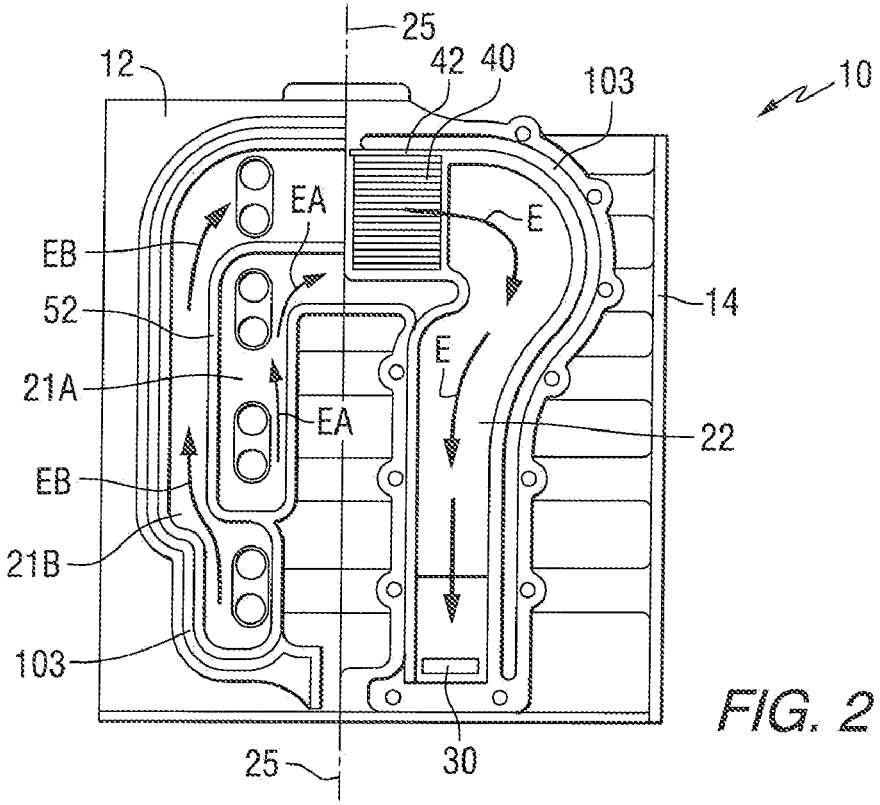
FIG. 2 is generally similar to FIG. 1, but with a dividing wall which segregates the exhaust into two paths as the exhaust is directed toward a catalyst member.

FIG. 2 illustrates an alternative embodiment of the present invention. The embodiment shown in FIG. 2 is generally similar to the embodiment shown in FIG. 1, but provides a divider 52, within the first exhaust conduit 21, which separates the first exhaust conduit into two portions, 21A and 21B. As a result, the first exhaust conduit is divided into a plurality of paths in order to segregate the exhaust from a first plurality of combustion chambers from the exhaust from a second plurality of combustion chambers. These two paths are identified by exhaust flows EA and EB. The middle two combustion chambers of the four cylinder engine 10 shown in FIG. 2, with two exhaust ports from each combustion chamber, emit exhaust into the portion 21A of the first exhaust conduit. The outer two combustion chambers, with two exhaust ports provided from each combustion chamber, emit their exhaust EB along the path illustrated in FIG. 2. This division is accomplished by a divider such as wall 52. The two parallel paths, EA and EB, are then directed to flow in a generally horizontal direction through the catalyst member 40 within the cavity 42. The embodiment of the present invention shown in FIG. 2 places the catalyst member 40 completely within the engine block portion 14. However, as described above in conjunction with FIG. 1, the cavity 42 could also be placed either completely within the engine head portion 12 or partially in the head portion and partially in the block portion.

Figure 3:
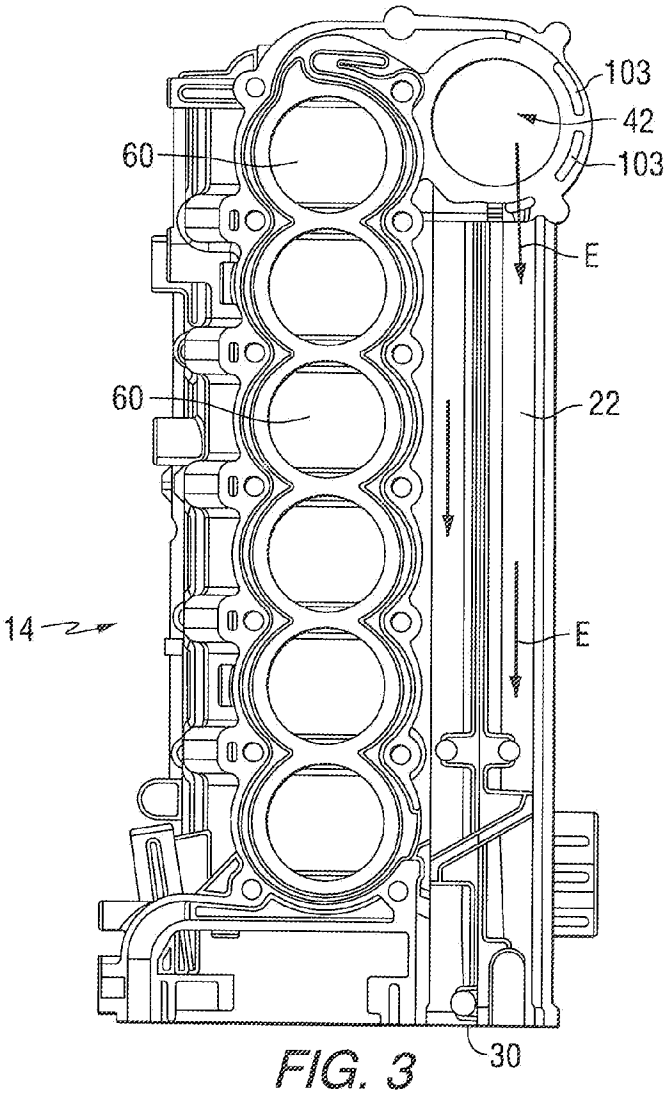
FIG. 3 shows an engine block portion made in accordance with a preferred embodiment of the present invention.

FIG. 3 shows an engine block portion 14 with the engine head portion removed. The engine block portion 14 shown in FIG. 3 is a six cylinder block portion. The cylinders are identified by reference numeral 60. The cavity 42 is located at the uppermost portion of the second exhaust conduit 22. Arrows E illustrate the path along which the exhaust passes through the second exhaust conduit 22 and downwardly away from the cavity 42. The exhaust is directed downwardly through the exhaust outlet 30 of the engine. FIG. 3 shows the integral nature of the second exhaust passage in relation to the block portion 14.

Figure 4:
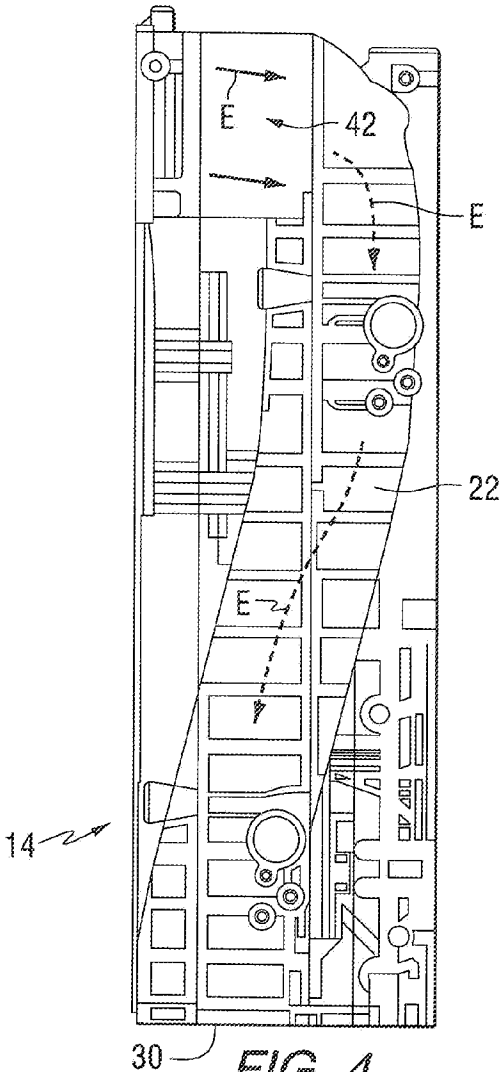
FIG. 4 is a side view of the engine block portion shown in FIG. 3.

FIG. 4 is a side view of the engine block portion 14 shown in FIG. 3. It shows the location of the cavity 42 and the direction of the second exhaust conduit 22 which extends downwardly from the cavity 42 toward the exhaust outlet 30 at the bottom portion of the engine block portion 14.

Figure 5:
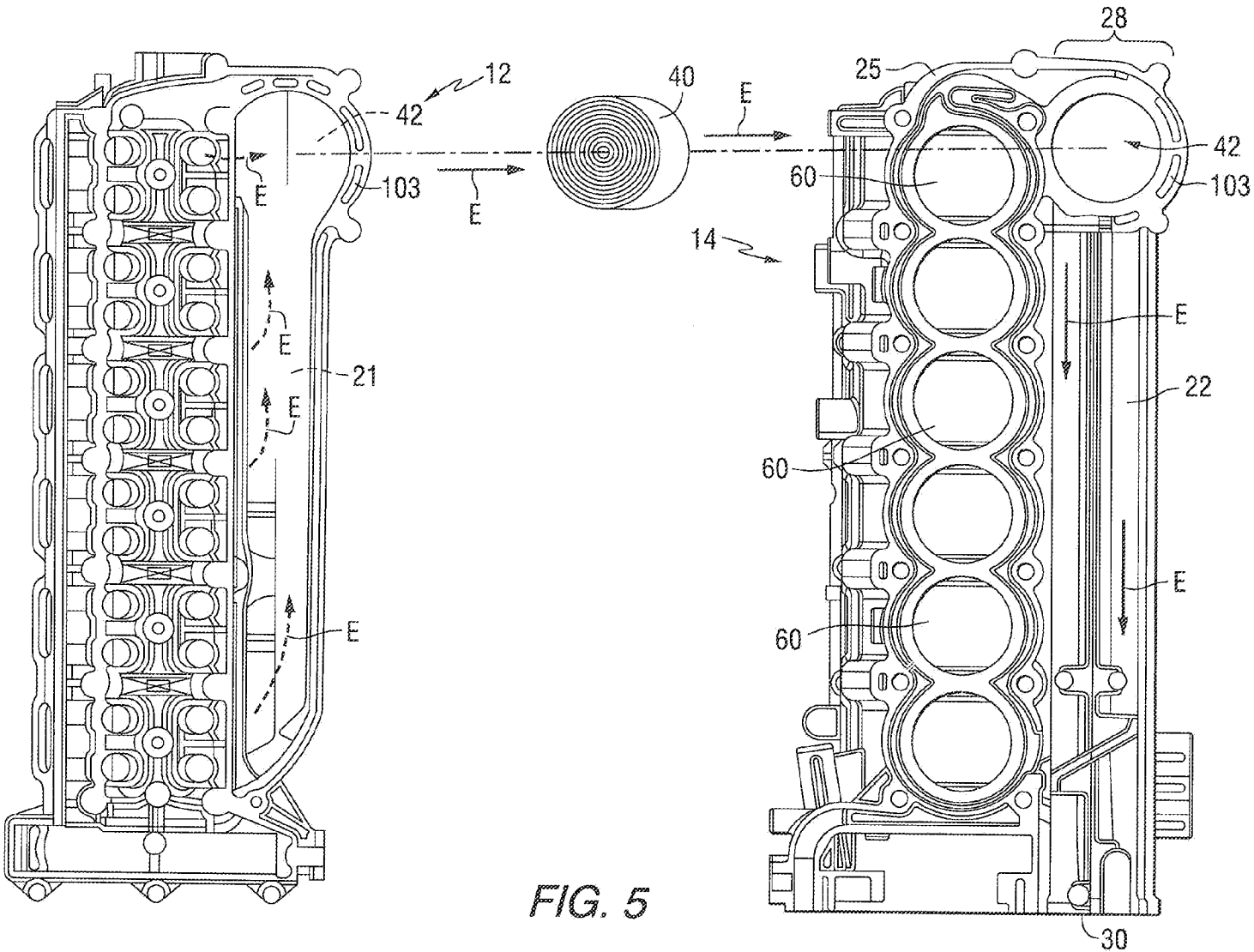
FIG. 5 is an exploded view of a six cylinder engine incorporating one embodiment of the present invention.

FIG. 5 is an exploded view of an engine showing an outer surface of the head portion 12 and the connection plane 25 of the parting surface of the engine is block portion 14. The exhaust is represented by dashed line arrows E in the first exhaust conduit 21 of the engine head portion 12 and by solid line arrows E in the second exhaust conduit 22 of the engine block portion 14. The catalyst member 40 is shown between the engine head portion and the engine block portion. As can be seen, the catalyst member 40 is shaped to be received within the cavity 42 and is generally configured to comprise a plurality of passages formed through it. The plurality of passages are disposed generally in parallel association with a flow of exhaust E as the exhaust passes from the upper end of the first exhaust conduit 21 through the cavity 42 at the intersection 28 between the first and second exhaust passages. After passing through the catalyst member 40, the exhaust is directed downwardly through the second exhaust conduit 22 toward the exhaust outlet 30 at the bottom portion of the engine. In the embodiment shown in FIG. 5, the cavity 42 is formed in both the engine head portion 12 and the engine block portion 14. As a result, the catalyst member 40 is contained partially within the engine head portion and partially within the engine block portion. When the engine head portion is rigidly attached to the engine block portion, the catalyst member 40 is retained between them within the cavity 42 and maintained in its proper position so that the exhaust flow must pass through the catalyst member 40 as it flows from the first exhaust conduit 21 to the second exhaust conduit 22.

Figure 6:
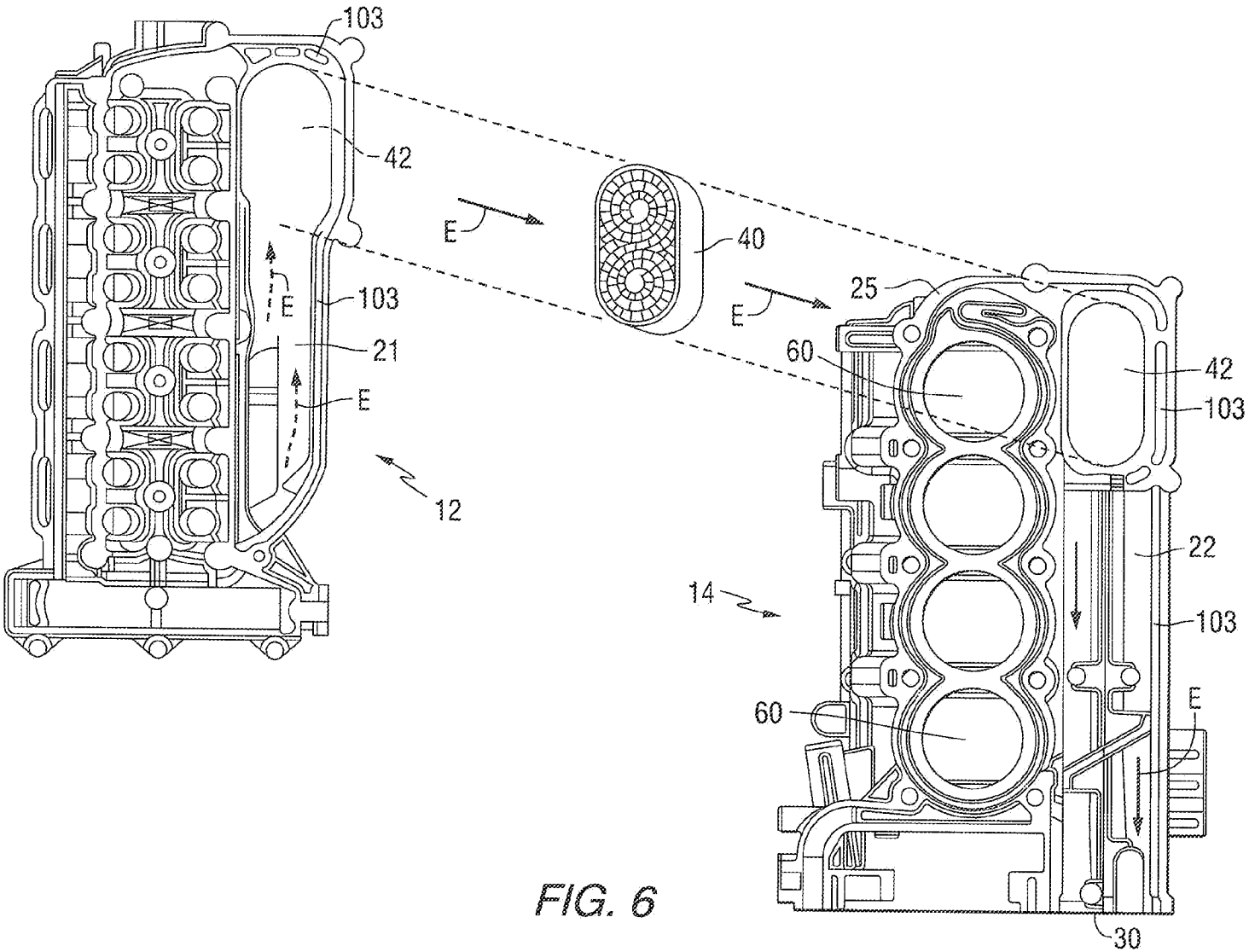
FIG. 6 is an exploded view of a four cylinder engine illustrating an alternative embodiment of the present invention.

FIG. 6 shows an alternative embodiment of the present invention. The engine illustrated in the exploded view of FIG. 6 is a four cylinder in-line engine. The engine head portion 12 is illustrated with its external surface being visible and the engine block portion 14 is illustrated with its parting surface 25 visible. It should be understood that, as in FIG. 5 described above, the parting surface 25 of the engine head portion 12 is not visible in FIG. 6 because the outer surface of the engine head portion 12 is visible. In the embodiment shown in FIG. 6, the cavity 42 is not circular in cross section as was the case in the embodiments described above. Instead, it is oblong in order to accommodate the shape of the catalyst member 40. As in the embodiments described above, the exhaust travels along the directions represented by arrows E. This directs the exhaust E upwardly through the first exhaust conduit 21, horizontally through the cavity 42, and downwardly through the second exhaust conduit 22. This exhaust E is then directed toward and through the exhaust outlet 30.

Figure 7:
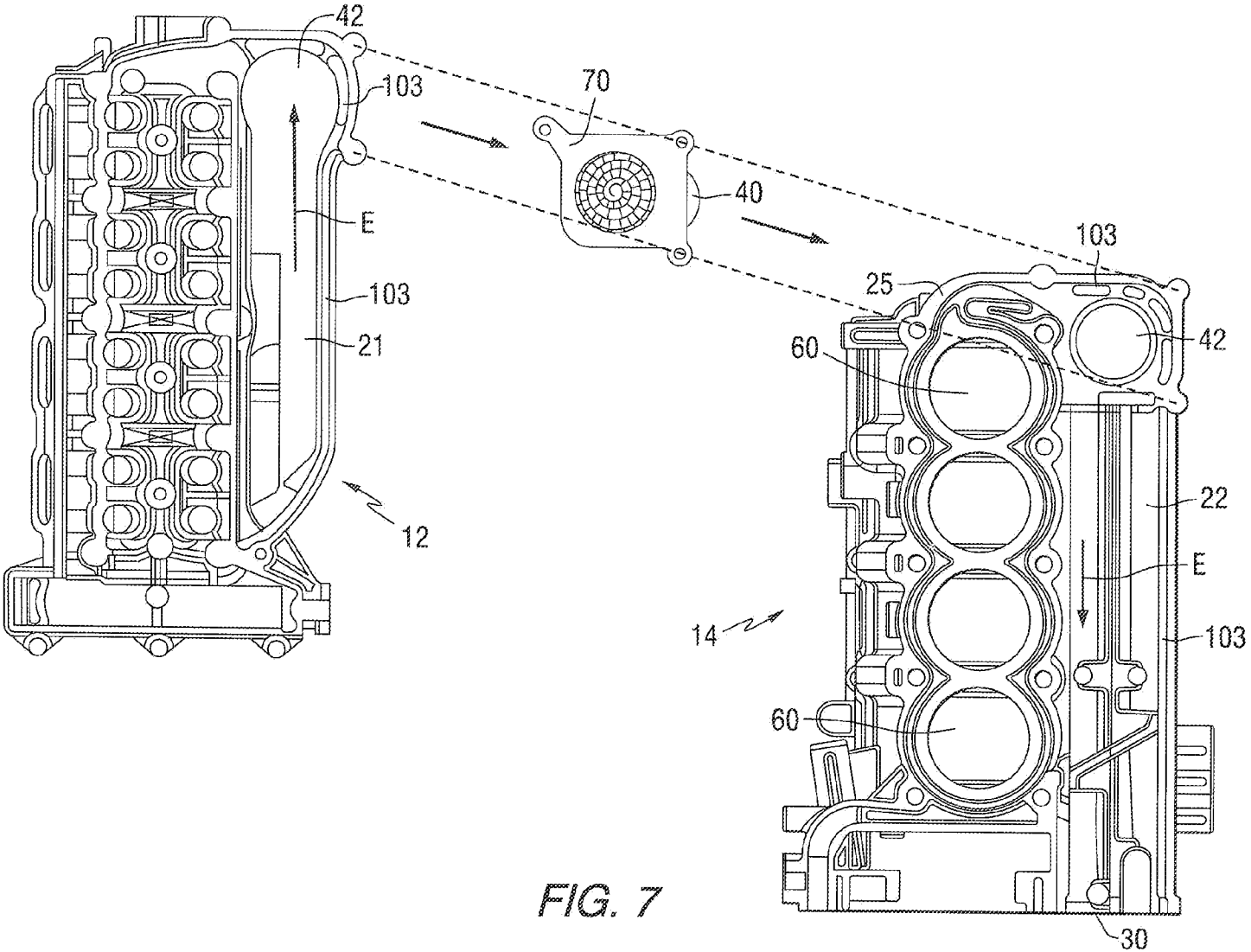
FIG. 7 is an exploded view of a four cylinder engine showing an alternative embodiment of the present invention.

The embodiment of the present invention shown in FIG. 7 is represented in a manner generally similar to FIGS. 5 and 6, but with a slightly different configuration of the catalyst member 40. The engine in the exploded view of FIG. 7 is a four cylinder in-line engine. As in FIGS. 5 and 6, the engine head portion 12 in FIG. 7 is illustrated with its outer surface visible and the engine block portion 14 is illustrated with its parting surface 25 visible. The catalyst member 40 is provided with a housing bracket and attachment plate 70 which can provide additional attachment between the housing portion of the catalyst member 40 and the surface of the connection plane 25 of the engine block portion 14. It should be understood, however, that the particular shape or configuration of the catalyst member 40 is not limiting to the present invention. In the embodiment shown in FIG. 7, the catalyst member 40 is contained completely within the engine block portion 14 with the plate 70 being located at the connection plane 23.

With reference to FIGS. 1-7, the present invention has been described in terms of several embodiments. These embodiments show its application in conjunction with both four and six cylinder engines 10. Furthermore, the catalyst member 40 is illustrated in various different types of alternative shapes. The catalyst member 40 is also illustrated and described as being positioned at different locations relative to the engine head portion 12 and the engine block portion 14. It should be understood that the catalyst member 40, and the cavity 42 in which it is contained, can be located completely within the engine head portion 12, completely within the engine block portion 14, or partially within both the engine head portion and the engine block portion. The first exhaust conduit 21 is formed integrally within the engine head portion 12 and the second exhaust conduit 22 is formed integrally within the engine block portion 14. The engine head portion 12 and the engine block portion 14 are attachable to each other at a connection plane 25 to form the engine 10. The first and second exhaust conduits, 21 and 22, are connectable to each other in fluid communication at the intersection 28 to direct the exhaust E from the engine head portion 12 to an exhaust outlet 30 of the engine. The first exhaust conduit 21 is configured to direct the exhaust upwardly from the engine head portion 12 toward the intersection 28 and the second exhaust conduit 22 is configured to direct the exhaust E downwardly from the intersection 28 to the exhaust outlet 30 of the engine. In a preferred embodiment of the present invention, the first and second conduits, 21 and 22, are arranged in parallel association with each other and with the axis of rotation of the engines' crankshaft. In a preferred embodiment of the present invention, the cavity 40 is located within the upper portion of the engine 10 and directs the exhaust E through the catalyst member 40 along a generally horizontal path which is perpendicular to both the first and second exhaust conduits. The catalyst member 40 is shaped to be received within the cavity 42 which is formed within the body of the engine. The cavity 42 is shaped to receive the catalyst member 40 therein and the catalyst member 40 is disposed within the cavity 42 prior to attachment of the engine head portion 12 to the engine block portion 14. The catalyst member 40 is retained within the cavity 42 as a result of the attachment of the engine head portion 12 to the engine block portion 14. The exhaust E is directed to pass through the cavity 42 along a generally horizontal path. The cavity 42 is preferably formed in the upper half of the engine 10 at the intersection 28 and, in a most preferred embodiment of the present invention, the cavity 42 is located at the highest point of the first and second exhaust conduits, 21 and 22. The catalyst member 40 comprises a plurality of passages formed therethrough and these passages are disposed generally in parallel association with a flow of exhaust E through the cavity 42. The intersection 28 is preferably located above a vertical midpoint of the first exhaust conduit 21. In certain embodiments, the intersection is disposed completely above the first exhaust conduit 21. In a particularly preferred embodiment of the present invention, the first and second exhaust conduits, 21 and 22, are positioned so that they are parallel to each other. This results in the exhaust E being directed in an upwardly vertical direction toward the cavity 42 and then in a downwardly vertical direction away from the cavity 42 toward the exhaust outlet 30 of the engine. In certain embodiments of the present invention, the first exhaust conduit 21 is divided into a plurality of paths, as illustrated in FIG. 2, in order to segregate exhaust from a first plurality of combustion chambers of the engine from a second plurality of combustion chambers of the engine as the exhaust is directed toward the cavity 42. Throughout the drawings, water cooling passages have been identified by reference numeral 103. Although the shape and position of these cooling passages are not limiting to the present invention, it should be understood that the present invention can benefit from the arrangement of water passages around the catalyst member 40. This allows the overall system to control the temperature of the catalyst member 40 and to control the temperature of the engine block more effectively, particularly in the region where the catalyst member 40 is contained. These water cooling passages 103 are shown in several of the figures and are illustrated as being located in both the engine head and engine block.

Although the present invention has been described with particular specificity and illustrated to show a preferred embodiment, it should be understood that alternative embodiments are also within its scope.

We claim:

1. An engine of a marine propulsion system, comprising:

an engine head portion having a first exhaust conduit formed integrally within said engine head portion;

an engine block portion having a second exhaust conduit formed integrally within said engine block portion, said engine block portion and said engine head portion being attachable to each other at a connection plane, to form said engine;

said first and second exhaust conduits being connectable to each other in fluid communication at an intersection to direct exhaust from said engine head portion to an exhaust outlet of said engine, said first exhaust conduit being configured to direct said exhaust upwardly from said engine head portion toward said intersection, said second exhaust conduit being configured to direct said exhaust downwardly from said intersection to said exhaust outlet of said engine;

a catalyst member; and a cavity formed within the body of said engine, said cavity being shaped to receive said catalyst member therein, said catalyst member being disposed within said cavity.

2. The engine of claim 1, wherein:

said cavity is formed entirely within said engine block portion.

3. The engine of claim 1, wherein:

said cavity is formed entirely within said engine head portion.

4. The engine of claim 1, wherein:

said cavity is formed partially within said engine block portion and partially within said engine head portion.

5. The engine of claim 1, wherein:

said catalyst member is retained within said cavity by the attachment of said engine head portion to said engine block portion.

6. The engine of claim 1, wherein:

said exhaust is directed to pass through said cavity along a generally horizontal path.

7. The engine of claim 1, wherein:

said cavity is located in an upper half of said engine.

8. The engine of claim 1, wherein:

said cavity is located at said intersection.

9. The engine of claim 1, wherein:

said cavity is located at a highest point of said first and second exhaust conduits.

10. The engine of claim 1, wherein:

said catalyst member comprises a plurality of passages formed therethrough, said plurality of passages being disposed generally in parallel association with a flow of exhaust through said cavity.

11. The engine of claim 1, wherein:

said intersection is disposed above a vertical midpoint of said first exhaust conduit.

12. The engine of claim 1, wherein:

said intersection is disposed above said first exhaust conduit.

13. The engine of claim 1, wherein:

14. The engine of claim 1, wherein:

said first exhaust conduit is divided into a plurality of paths to segregate exhaust from a first plurality of combustion chambers of said engine from a second plurality of combustion chambers of said engine as said exhaust is directed toward said cavity.

15. The engine of claim 1, wherein:

said engine comprises four cylinders.

16. The engine of claim 1, wherein:

said engine comprises six cylinders.

17. An engine of a marine propulsion system, comprising:

an engine head portion having a first exhaust conduit formed integrally within said engine head portion;

an engine block portion having a second exhaust conduit formed integrally within said engine block portion, said engine block portion and said engine head portion being attachable to each other at a connection plane to form said engine;

said first and second exhaust conduits being connectable to each other in fluid communication at an intersection to direct exhaust from said engine head portion to an exhaust outlet of said engine, said first exhaust conduit being configured to direct said exhaust upwardly from said engine head portion toward said intersection, said second exhaust conduit being configured to direct said exhaust downwardly from said intersection to said exhaust outlet of said engine;

a catalyst member; and a cavity formed within the body of said engine, said cavity being shaped to receive said catalyst member therein, said catalyst member being disposed within said cavity, said cavity being located at said intersection in an upper half of said engine, said catalyst member being retained within said cavity by the attachment of said engine head portion to said engine block portion.

18. The engine of claim 17, wherein:

said catalyst member comprises a plurality of passages formed therethrough, said plurality of passages being disposed generally in parallel association with a flow of exhaust through said cavity.

19. The engine of claim 18, wherein:

said exhaust is directed to pass through said cavity along a generally horizontal path.

20. The engine of claim 19, wherein:

said cavity is formed partially within said engine block portion and partially within said engine head portion.

21. The engine of claim 17, wherein:

said cavity is located at a highest point of said first and second exhaust conduits.

22. The engine of claim 17, wherein:

said intersection is disposed above said first exhaust conduit.

23. The engine of claim 17, wherein:

said intersection is disposed above said second exhaust conduit.

24. The engine of claim 17, wherein:

said first exhaust conduit is divided into a plurality of paths to segregate exhaust from a first plurality of combustion chambers of said engine from a second plurality of combustion chambers of said engine as said exhaust is directed toward said cavity.

25. The engine of claim 24, wherein:

said engine comprises four cylinders.

26. The engine of claim 25, wherein:

27. An engine of a marine propulsion system, comprising:

an engine head portion having a first exhaust conduit formed integrally within said engine head portion;

an engine block portion having a second exhaust conduit formed integrally within said engine block portion, said engine block portion and said engine head portion being attachable to each other at a connection plane to form said engine;

said first and second exhaust conduits being connectable to each other in fluid communication at an intersection to direct exhaust from said engine head portion to an exhaust outlet of said engine, said first exhaust conduit being configured to direct said exhaust upwardly from said engine head portion toward said intersection, said second exhaust conduit being configured to direct said exhaust downwardly from said intersection to said exhaust outlet of said engine;

a catalyst member; and a cavity formed within the body of said engine, said cavity being shaped to receive said catalyst member therein, said catalyst member being disposed within said cavity, said cavity being located at said intersection in an upper half of said engine, said catalyst member being retained within said cavity by the attachment of said engine head portion to said engine block portion, said catalyst member comprising a plurality of passages formed therethrough, said plurality of passages being disposed generally in parallel association with a flow of exhaust through said cavity.

28. The engine of claim 27, wherein:

said exhaust is directed to pass through said cavity along a generally horizontal path.

29. The engine of claim 28, wherein:

said cavity is formed partially within said engine block portion and partially within said engine head portion.

30. The engine of claim 27, wherein:

said cavity is located at a highest point of said first and second exhaust conduits.

31. The engine of claim 27, wherein:

said first exhaust conduit is divided into a plurality of paths to segregate exhaust from a first plurality of combustion chambers of said engine from a second plurality of combustion chambers of said engine as said exhaust is directed toward said cavity.

32. An engine of a marine propulsion system, comprising:

an engine head portion having a first exhaust conduit formed integrally within said engine head portion;

an engine block portion having a second exhaust conduit formed integrally within said engine block portion, said engine block portion and said engine head portion being attachable to each other at a connection plane to form said engine, said first and second exhaust conduits being generally parallel to each other and arranged to direct a flow of exhaust along generally vertical paths;

said first and second exhaust conduits being connectable to each other in fluid communication at an intersection to direct exhaust from said engine head portion to an exhaust outlet of said engine, said first exhaust conduit being configured to direct said exhaust upwardly from said engine head portion toward said intersection, said second exhaust conduit being configured to direct said exhaust downwardly from said intersection to said exhaust outlet of said engine;

a catalyst member; and a cavity formed within the body of said engine, said cavity being shaped to receive said catalyst member therein, said catalyst member being disposed within said cavity.

33. The engine of claim 32, wherein:

said catalyst member is retained within said cavity by the attachment of said engine head portion to said engine block portion.

34. The engine of claim 33, wherein:

said exhaust is directed to pass through said cavity along a generally horizontal path.

35. The engine of claim 34, wherein:

said cavity is located at said intersection.

36. The engine of claim 35, wherein:

said catalyst member comprises a plurality of passages formed therethrough, said plurality of passages being disposed generally in parallel association with a flow of exhaust through said cavity.

37. The engine of claim 36, wherein:

said first exhaust conduit is divided into a plurality of paths to segregate exhaust from a first plurality of combustion chambers of said engine from a second plurality of combustion chambers of said engine as said exhaust is directed toward said cavity.

* * * * *